US008409358B2

(12) United States Patent
Bouix et al.

(10) Patent No.: US 8,409,358 B2
(45) Date of Patent: Apr. 2, 2013

(54) CLEANING TOOL FOR PERSONAL CARE APPLICATOR

(75) Inventors: Herve F. Bouix, New York, NY (US); Francis Corbellini, Thfais (FR); William Robert Bickford, Ronkonkoma, NY (US)

(73) Assignee: ELC Management, LLC, New York, NY (US)

( * ) Notice: Subject to any disclaimer, the term of this patent is extended or adjusted under 35 U.S.C. 154(b) by 0 days.

(21) Appl. No.: 13/183,661

(22) Filed: Jul. 15, 2011

(65) Prior Publication Data

US 2013/0014781 A1 Jan. 17, 2013

(51) Int. Cl.
*B08B 1/00* (2006.01)

(52) U.S. Cl. ..... 134/6; 134/8; 134/9; 134/22.1; 134/32; 134/42; 401/121; 401/122; 15/104.001; 15/142; 15/236.01; 15/236.05; 15/236.06; 15/236.07; 15/236.08; 15/236.09

(58) Field of Classification Search ..... 401/121, 401/122; 15/104.001, 142, 236.01, 236.05, 15/236.06, 236.07, 236.08, 236.09; 134/6, 134/8, 9, 22.1, 32, 42
See application file for complete search history.

(56) References Cited

U.S. PATENT DOCUMENTS

| | | | | |
|---|---|---|---|---|
| 5,397,193 | A * | 3/1995 | Kirk et al. | 401/122 |
| 5,951,185 | A * | 9/1999 | Kingsford et al. | 401/99 |
| 7,476,044 | B2 * | 1/2009 | Gueret | 401/122 |
| 7,971,310 | B2 * | 7/2011 | Metaxatos et al. | 15/105 |
| 2007/0177927 | A1 * | 8/2007 | Kurihara | 401/122 |
| 2007/0209133 | A1 * | 9/2007 | Linzell | 15/209.1 |

* cited by examiner

*Primary Examiner* — Bibi Carrillo
(74) *Attorney, Agent, or Firm* — Peter Giancana

(57) ABSTRACT

A tool for cleaning a personal care applicator, particularly an applicator for a product that is subject to dry out. In some embodiments, the invention is implemented as a reusable cleaning tool. In other embodiments, the invention is implemented as a disposable, single-use or limited use cleaning tool. The tool comprises a relatively flat body having first and second exterior surfaces, and one or more cleaning regions that extend through the body. As an applicator is drawn through the cleaning region, dried out product is scraped off the applicator.

1 Claim, 9 Drawing Sheets

Section B-B

Section C-C

CLEANING TOOL FOR PERSONAL CARE APPLICATOR

FIELD OF THE INVENTION

The present invention pertains to tools for cleaning applicators that heat a product. Specifically, the invention is a reusable or disposable tool that cleans a cosmetic or personal care heating applicator between uses.

BACKGROUND OF THE INVENTION

Cosmetic and personal care applicators that heat a product have recently begun to appear on the market. Examples of products with a heating applicator include heated mascaras, heated lip glosses, heated acne pens, and other heated treatment products. One of the difficulties in bringing such products to market is that the heat may cause dry out and hardening of the product. The product may dry out in the reservoir or on the applicator head. By "applicator head" we mean that portion or surface of the applicator that is designed to deliver product onto a target surface, such as the skin or hair. When dried-out product accumulates on the applicator head, it may interfere with the performance of the applicator and/or it may contaminate product in the reservoir. While various types of products may dry out after one or more exposures to the elevated temperatures, mascara seems to be particularly susceptible. Mascara is a sticky, viscous product. Once a mascara applicator head (typically a bristle brush) has been dipped into a product reservoir, there is always product residue that remains on the applicator head. After one or more uses of a heated mascara applicator, the product residue dries out to form a hardened mass, that may subsequently flake off of the brush, perhaps onto the eyelashes, the skin or clothing, or in the reservoir. Keeping a mascara brush clean has always been a prime concern of mascara product manufacturers and users. With non-heating applicators, the combination of the container wiper and the user wiping the brush with a tissue may be a suitable solution. But with the appearance of heating applicators, this is no longer the case. What is needed is a simple, inexpensive, repeatable method of cleaning a heating applicator, especially a mascara applicator or applicator for a product that is subject to dry out, like mascara.

OBJECTS OF THE INVENTION

One main object of the invention is to provide an effective and inexpensive, non-chemical way of cleaning dried out product from off of a heating cosmetic or personal care applicator.

Another main object of the invention is to provide an effective and inexpensive cleaning tool that mechanically removes dried out product from a heating cosmetic or personal care applicator.

SUMMARY OF THE INVENTION

The invention comprises a tool for cleaning a personal care applicator between uses, particularly a heating applicator, particularly a heating applicator for applying mascara or other product subject to dry out. In some embodiments, the invention is implemented as a reusable cleaning tool. In other embodiments, the invention is implemented as a disposable, single-use or limited use cleaning tool. The tool comprises a relatively flat body having first and second exterior surfaces, and one or more cleaning regions that extend through the body. As an applicator is drawn through the cleaning region, dried out product is scraped off the applicator. The cleaning region may be configured to effectively clean a particular type of applicator head. It may also be configured to clean some other part of the applicator in addition to the applicator head. In some embodiments, after cleaning the applicator, all or part of the cleaning tool may be disposed. In some embodiments, the cleaning tool may itself be cleaned so that it can be reused.

DETAILED DESCRIPTION OF THE INVENTION

Figure 1B:
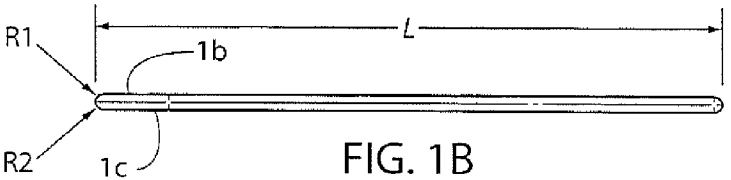
FIG. 1B is an elevation view of the tool of FIG. 1A.

Assorted types of personal care applicators are comprise an applicator head that is used to deliver product to a target surface. A cleaning tool according to the present invention may be useful to clean various types of applicator heads, but is particularly useful for cleaning heated mascara applicators. The tool may also be used to clean a non-heating applicator head, however, without loss of generality, we describe the invention in relation to heating applicator heads.

Throughout this specification, the terms "comprise," "comprises," "comprising" and the like shall consistently mean that a collection of objects is not limited to those objects specifically recited. By "applicator head" we mean that portion of a cosmetics or personal care applicator that is specifically designed to deliver product to a target surface and/or specifically designed to distribute product over a target surface. For example, in a mascara brush, the bristles collectively form the applicator head.

Reusable Cleaning Tools

A cleaning tool of the present invention comprise one or more cleaning regions. A cleaning region is a part of the tool that moves relative to an applicator head to clean the applicator head. Generally, a cleaning region comprises as a passageway that has first and second ends, and that passes completely through the tool. By "completely through the tool" we mean that the first end of the passageway opens up onto a first portion of an exterior surface of the tool, and the second end of the passageway opens up onto a second portion of an exterior surface of the tool, such that an applicator head is able to enter the first end of the passageway and emerge from the second end of the passageway. In the process, the applicator head is scraped clean. The shape and length of the passageway facilitate cleaning of the applicator head.

For example, in the embodiment of FIGS. 1A-1E, a cleaning tool (1) for a heating applicator comprises a relatively flat body (1*a*) that has first and second exterior surfaces (1, 1*c*). The flat body (1*a*) comprises a cleaning region (1*d*) that has a passageway (1*k*) that extends completely through the body. A first end of the passageway opens up onto a first portion (1*p*) of exterior surface (1*b*), and a second end of the passageway opens up onto a second portion (1*q*) of exterior surface (1). Preferably, the first and second portions (1*p*, 1*q*) are parallel to each other (or nearly so), and the passageway (1*k*) is straight and perpendicular to the first and second portions. Alternatively, the passageway (1*k*) may be curved, but in this case, the applicator must be able to bend as the applicator head moves through the passageway.

Preferably, the shape of a cleaning region (1*d*) is designed to effectively clean a particular type of applicator head. Thus, while a simple circular passageway would provide some cleaning effect for simple applicator heads, other cleaning regions comprise inwardly directed projections (1*e*) separated by outwardly directed spaces (1*f*). The inwardly directed projections extend into the passageway (1*k*), and are positioned to penetrate into the applicator head.

In some useful embodiments, the inwardly directed projections (1*e*) are arranged essentially in a plane, along the circumference of a circle, and extend in a radial direction toward the center of the passageway (1*k*). For example, a heating mascara brush applicator is effectively cleaned by a regular, star shaped design, such as that shown in FIG. 1A. In FIG. 1A, the regular, star shaped design comprises an array of triangular projections (1*e*) arranged along ¾ of the circumference of a circle, and pointing radially into the passageway (1*k*). In the specific embodiment of FIG. 1, the number of the triangular projections is 8, evenly spaced about 33.75° apart, and the spaces (1*f*) between the projections are also triangular. As a brush head and cleaning tool move relative to each other, the triangular projections penetrate into the brush head and scrape residual product off of the bristles.

Less preferably, the inwardly directed projections (1*e*) may not be arranged along the circumference of a circle, and/or may not extend in a radial direction. For example, the projections could be arranged along the perimeter of square or some other shape, with some of the projections extending in a first direction and some of the projections extending in a second direction that is perpendicular to the first direction.

Alternatively, all of the inwardly directed projections (1*e*) may not lie in a plane, but may be located along different portions of the length of the passageway (1*k*). In any of the embodiments, the total number of projections associated with a single passageway is limited by the space available in the passageway and the desired cleaning effect. As guidance, effective cleaning tools may be constructed with about 4 to about 64 inwardly directed projections, for example about 8 to about 32, preferably about 8 to about 16, for example 10-12.

We define a central axis of the passageway as a line that extends along the length of the passageway; that is, from the first portion (1*p*) to the second portion (1*q*) of the first and second exterior surfaces (1, 1*c*), whether or not that line is straight or curved. We define movement "parallel to the passageway" as movement along the central axis of the passageway (for example, as indicated by the arrow in FIG. 9B). In general, an applicator head may be inserted into the passageway (1*k*) by moving the applicator head parallel to the passageway. However, in the embodiment of FIG. 1, the passageway also opens up, all along its length, onto outer edges (1s, 1s') of the body (1*a*), such that an applicator may be inserted into the passageway by moving the applicator perpendicularly to the passageway (for example, as indicated by the arrow in FIG. 9C). In this and other embodiments (FIGS. 3-6), an opening (1*i*) is defined by an angle (1*j*). In general, this angle may be from 0° (1s and 1s' are parallel) to 180° (1s and 1s' are co-linear). Preferably, this angle is from about 15° to about 90°, more preferably from about 15° to about 60°, even more preferably from about 15° to about 45°. A smaller angle may make it easier to provide more space for the inwardly directed projections (1*e*).

In embodiments that do not have this optional feature (such as those of FIGS. 2A and 2B) an applicator head must be drawn back and forth through the passageway (1*k*) in order to clean the applicator head. However, the act of pulling the applicator head toward a user may cause back splatter of the product onto the user. For example, when a bristled applicator head is pulled through the passageway of the cleaning region, toward the user, the bristles will initially bend away from the user, and then snap back toward the user. This may splatter product onto the user or other surface.

In contrast, when the passageway (1*k*) opens up onto an outer edge of the body (1*a*), a user can avoid back splatter by first pushing the applicator head through the cleaning region (1*d*) in a direction that is parallel to the passageway, and then moving the applicator in a direction that is perpendicular to the passageway, and out of the cleaning region. Thus, a preferred use may be to push the applicator head through the passageway of the cleaning region, away from the user, and then move the applicator perpendicularly to the passageway, to remove it from the cleaning tool. If desired, this motion may be repeated, without incurring back splatter.

For whatever reason, this motion could also be reversed: moving the applicator perpendicularly to the passageway (1*k*) into the cleaning region (1*d*), and then moving the applicator parallel to the passageway to draw the applicator head through the cleaning region. Furthermore, in those cases where splatter is not a concern, a user could simply draw an applicator head back and forth through the cleaning region, parallel to the passageway, even if the passageway opens onto an edge of the body (1*a*).

The width, W, of the cleaning region (1*d*) is the shortest distance across the passageway (1*k*). For example, in FIG. 1C, the width W is the distance between opposing triangular projections (1*e*', 1*e*"). Preferably, the width of the passageway is smaller than the diameter (or other relevant parameter) of the applicator head that is to be cleaned. This will ensure that all sides of the applicator head are scraped simultaneously by the cleaning tool. On the other hand, the passageway must be large enough to allow an applicator head to pass through, without undue effort on the part of a user. The actual width will depend on the applicator head that is being cleaned, but may typically vary from about 2 mm to about 20 mm, or more typically from about 4 to about 10 mm.

Figure 1C:
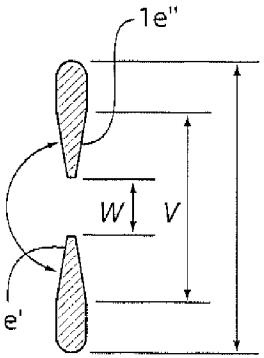
FIG. 1C is a cross section through line B-B of FIG. 1A.
Figure 1A:
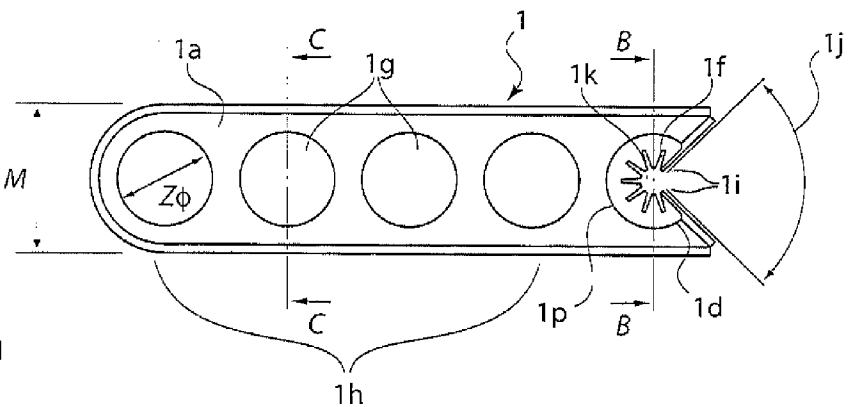
FIG. 1A depicts a cleaning tool that may itself be cleaned and reused.
Figure 1E:
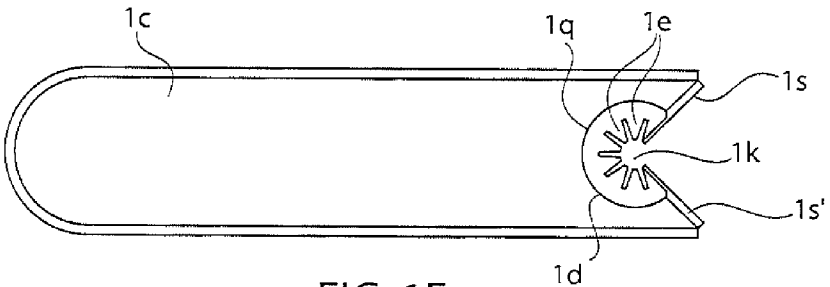
FIG. 1E depicts the bottom of the cleaning tool of FIG. 1A.

Referring to FIG. 1C, the length of an inwardly directed projection from base to tip is given by (V−W)/2. Typically, this length may vary from 2 mm to 10 mm, for example, from 4 mm to 8 mm, preferably from 4 mm to 6 mm.

To provide some resistance to the action of an applicator head moving through the cleaning region (1*d*), the inwardly directed projections (1*e*) of the cleaning tool (1) should be sufficiently rigid. In general, a thicker projection is more rigid and gives a better scraping effect. On the other hand, a thicker body means more waste, and makes the tool more expensive to manufacture. For guidance, in some embodiments the thickness of the inwardly directed projections may preferably be from about 0.5 mm to about 10 mm, for example, from 1 mm to 5 mm, or for example, from 1.5 mm to 3 mm, or for example, from 2 mm to 2.5 mm. Optionally (as shown in FIG. 1C), the inwardly directed projections may be tapered as you move toward the center of the cleaning region. The degree of taper will affect the flexibility and rigidity of the inwardly directed projections, and can be chosen to give the best cleaning for a given applicator head.

Figure 1D:
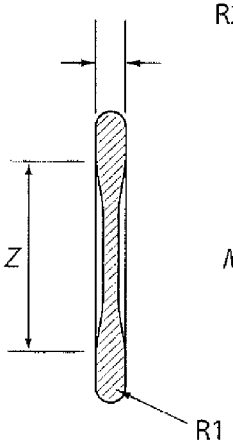
FIG. 1D is a cross section through line C-C of FIG. 1A.

In some embodiments of the reusable cleaning tool, the thickness of the body may typically range between about 0.5 mm and 20 mm, preferably between about 1 mm and 10 mm, more preferably between about 2 mm and about 5 mm. All of the body (1*a*) may be one thickness, or the thickness may vary. For example, if the body is molded of plastic or metal, depressions (1*g*) may be provided to increase the firmness of a user's grip. Such depressions may have a characteristic dimension Z, of about 5 mm to 20 mm, for example. Or, for example, the body may have embossed and/or debossed areas. Embossing and debossing may be used to provide information to a user, or to decorate the tool, or to increase the firmness of a user's grip, or to increase the strength and structural integrity of the tool, or for some other purpose. In the embodiment of FIG. 1, the variation in thickness across the body is best seen in FIG. 1D.

Optionally, the body (1*a*) comprises a grasping region (1*h*) that is free of any cleaning regions (1*d*). The grasping region allows a user to firmly grasp the tool in one hand during use. For example, in the elongated embodiment of FIG. (1A), the grasping region may be, for example, at least 10 mm in length, preferably at least 20 mm, more preferably at least 40 mm, and most preferably at least 60 mm, and preferably no more than about 100 mm in length. Overall, the cleaning tool may have a length, L, of about 20 mm to about 200 mm, preferably about 40 mm to about 100 mm. Overall, the cleaning tool may typically have a width, M, of about 20 mm to about 60 mm, preferably about 20 mm to about 40 mm. These ranges for the length L, and width M, are for convenient handling of the cleaning tool, and may be exceeded if other advantages would accrue.

A cleaning tool according to the embodiment of FIG. 1 may be molded in plastic, metal or other suitable material. A suitable material is one that is easy and inexpensive to mold, and one that is chemically compatible, under typical conditions of intended use, with the product that is being applied by the heated applicator. Preferably, the tool is made out of a material that is impervious to the products with which it will come into contact. Such a molded cleaning tool is intended to be reused any number of times, with occasional or as needed cleaning of the cleaning tool itself.

Disposable Cleaning Tools

In contrast to reusable cleaning tools, the present invention also contemplates single-use or limited-use, disposable cleaning tools. Disposable cleaning tools are preferably made out of paper having a grammage of at least about 100 g/m$^2$. For example, a disposable cleaning tool according to the present invention may be made out of card stock (approximately 135-300 g/m$^2$) or paperboard (above about 225 g/m$^2$). The paper must have sufficient rigidity to effectively clean an applicator head. Rigidity of paper varies based on several factors, but sufficient rigidity for the present purpose may be determined by trial and error. Less preferably, disposable cleaning tools may be made out of plastic or other material that does not decompose as readily as paper.

Figure 2A:
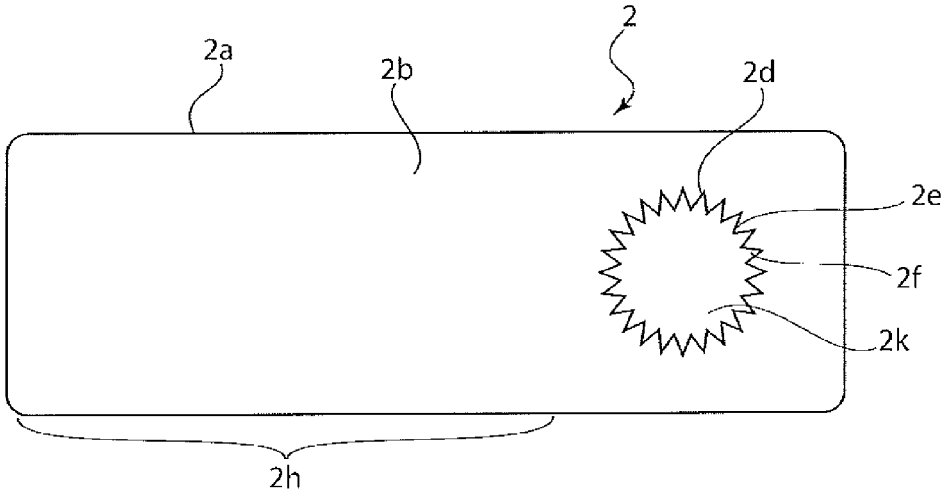
FIG. 2A depicts paper-based cleaning tool having a single cleaning region.

Referring to FIG. 2A, a single-use, disposable paper cleaning tool (2) for a heating applicator could be described analogously to the reusable tool described above. A flat body (2*a*) has first exterior surface (2*b*) and a second exterior surface (not visible in FIG. 2A), and comprises a single cleaning region (2*d*) having a passageway (2*k*) that extends through the body, from a first portion of the first exterior surface to a second portion of the second exterior surface. The cleaning region comprises inwardly directed projections (2*e*) separated by outwardly directed spaces (2*f*). The inwardly directed projections penetrate into the passageway where they may scrape an applicator head as it passes there through. For example, in FIG. 2A, a heating mascara brush applicator may be effectively cleaned by the regular, star shaped design that comprises an array of triangular projections (2*e*) arranged along the circumference of a circle, and pointing radially inward. In this embodiment, the number of the triangular paper projections shown is 24, evenly spaced about 15.83° apart, and the spaces (2*f*) between the projections are also triangular. As a brush head and cleaning tool move relative to each other, the triangular paper projections penetrate into the brush head and scrape residual product off of the bristles.

Figure 2B:
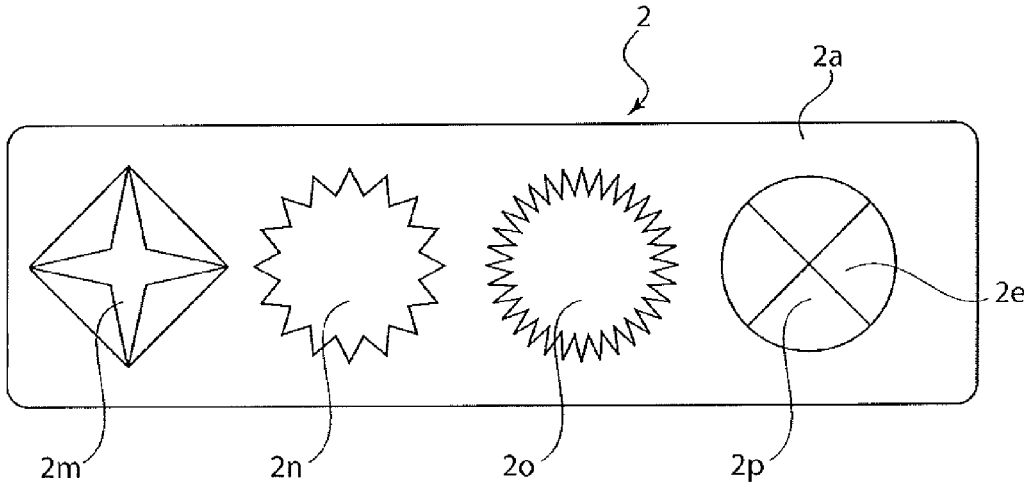
FIG. 2B depicts a paper-based cleaning tool having multiple cleaning regions.

A limited-use, disposable cleaning tool is shown in FIG. 2B. This disposable paper tool is entirely similar to the embodiment of FIG. 2A, except that it has more than one cleaning region. Each cleaning region is intended to be used only once, and when all cleaning regions have been used, the tool should be discarded. Therefore, the number of uses of this tool is limited to the number of cleaning regions provided. FIG. 2B depicts several different embodiments (2*m*, 2*n*, 2*o*, 2*p*) of the passageway of the cleaning region, however, a limited use cleaning tool may preferably have all the same type of passageway. The number of inwardly directed projections in passageway (2*m*) is 4. The number of inwardly directed projections in passageways (2*n*) and (2*p*) is 16. The number of inwardly directed projections in passageway (20) is 32. Of these, passageway 2*p* is different in that the inwardly directed triangular projections abut one another, so that there is effectively no space in between the projections.

As with the reusable embodiments described above, the width of the cleaning region is preferably smaller than the diameter (or other relevant parameter) of the applicator head that is to be cleaned. This will ensure that all sides of the applicator head are scraped simultaneously by the cleaning tool. On the other hand, the cleaning region must be large enough to allow an applicator head to pass through, without undue effort on the part of a user.

In the embodiments of FIGS. 2A and 2B, an applicator head must be inserted into the passageway (2*k*, 2*m*, 2*n*, 2*o*, or 2*p*) of the cleaning region by moving the applicator head parallel to the passageway, because in these embodiments, the passageways do not open up onto an outer edge of the body (2*a*), although this could be done.

To provide some resistance to the action of an applicator head moving through the passageway, the body (2*a*) of the disposable cleaning tool (2) should be sufficiently rigid. In general, a thicker body produces a more rigid tool and a better cleaning effect. On the other hand, a thicker body means more waste, and makes the tool more expensive to manufacture. For guidance, the thickness of the body may preferably be from 0.5 mm to 10.0 mm, for example, from 1.0 mm to 6.0 mm, or for example, from 2.0 mm to 4.0 mm. In principle, thicknesses larger than 10 mm could work, but are impractical.

As with the reusable embodiments described above, all of the disposable body (2*a*) may be one thickness, or the thickness may vary. For example, the body may have embossed and/or debossed areas. Embossing and debossing may be used to provide information to a user, or to decorate the tool, or to increase the firmness of a user's grip, or to increase the strength and structural integrity of the tool, or for some other purpose. Also, the body (2*a*) may comprises a grasping region (2*h* in FIG. 2A) that is free of any cleaning regions (2*d*). The grasping region allows a user to firmly grasp the tool in one hand during use. For example, in the elongated embodiment of FIG. (2A), the grasping region may be, for example, at least 10 mm in length, preferably at least 20 mm, more preferably at least 40 mm, and most preferably at least 60 mm. The width of the grasping region facilitates a firm grip on the device during use.

In contrast, FIGS. 3-6 depict embodiments of single use cleaning tools that may be more preferred. Referring to FIGS. 3A and 3B, one embodiment of a single-use cleaning tool (3) for a heating applicator comprises a relatively flat body (3*a*) that has a fold line (3*l*) along which the paper is able to be folded prior to use. Folding the paper body increases its rigidity, which should permit the use of a paper that would otherwise be insufficiently rigid. Also, once the paper body is folded, the structure of the cleaning tool is analogous to embodiments described above. The fold line may be an actual discontinuity in the structure of the paper that facilitates folding (for example, a crease) or just some indication of where the paper should be folded.

Figure 3A:
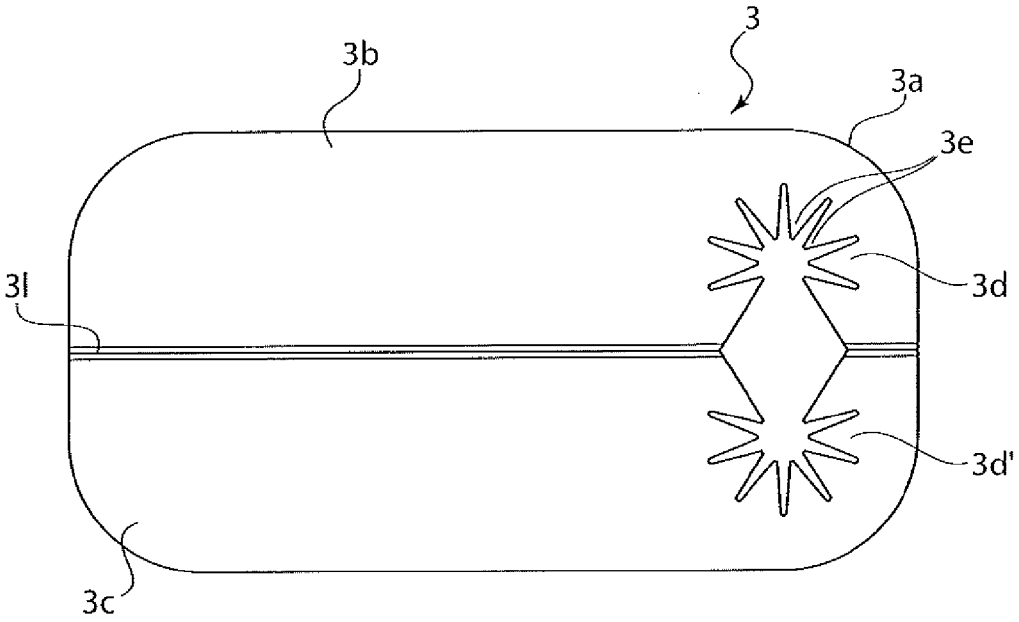
FIGS. 3A and 3B depict a disposable cleaning tool according to the present invention, unfolded (3A) and folded (3B).
Figure 3B:
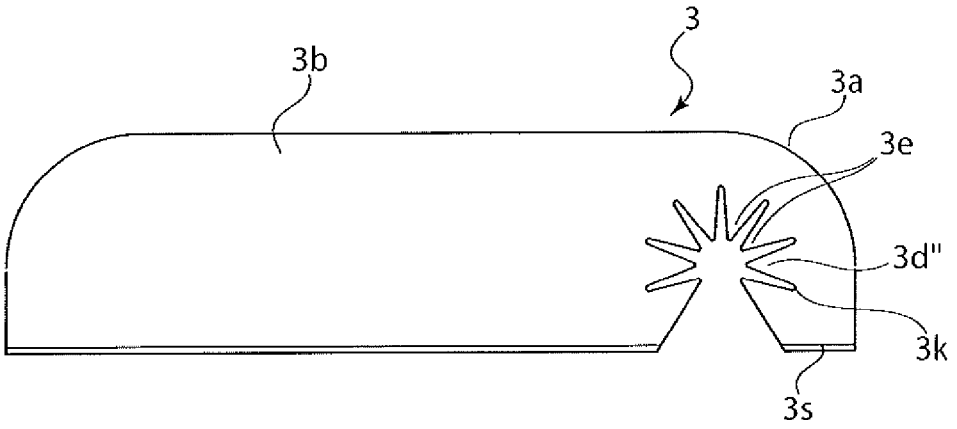

The body comprises set of complementary cleaning regions, a first exterior surface (3*b*) on one side of the fold line (3*l*) and a second exterior surface (3*c*) on the other side of the fold line. Surface (3*b*) comprises a first cleaning region (3*d*), and surface (3*c*) comprises a second cleaning region (3*d*'). Each cleaning region has a passageway that extends through the body. The first and second cleaning regions are positioned so that when the body is folded along the fold line, the cleaning regions are adjacent, and form a composite cleaning region (3*d*") that has a composite passageway (3*k*) that extends through the body of the tool. For this reason, it is preferred if the fold line is an actual discontinuity in the structure of the paper that facilitates folding (for example, a crease), to make sure that the complementary cleaning regions line up optimally. In FIGS. 3A and 3B, the seven inwardly directed projections (3*e*) are arranged around the circumference of a circle, spaced about 36° apart.

After folding, a portion of the body along the fold line (3*l*) becomes an outer edge (3s) of the body (3*a*). Optionally, but preferred, the first and second cleaning regions (3*d*, 3*d*'), open up onto the same section of the fold line, so that when the body is folded along the fold line, the composite passageway (3*k*) opens up onto this outer edge (3s) of the folded body. Like the reusable embodiments above, this opening may preferably be defined by an angle of about 15° to about 90°.

Figure 4A:
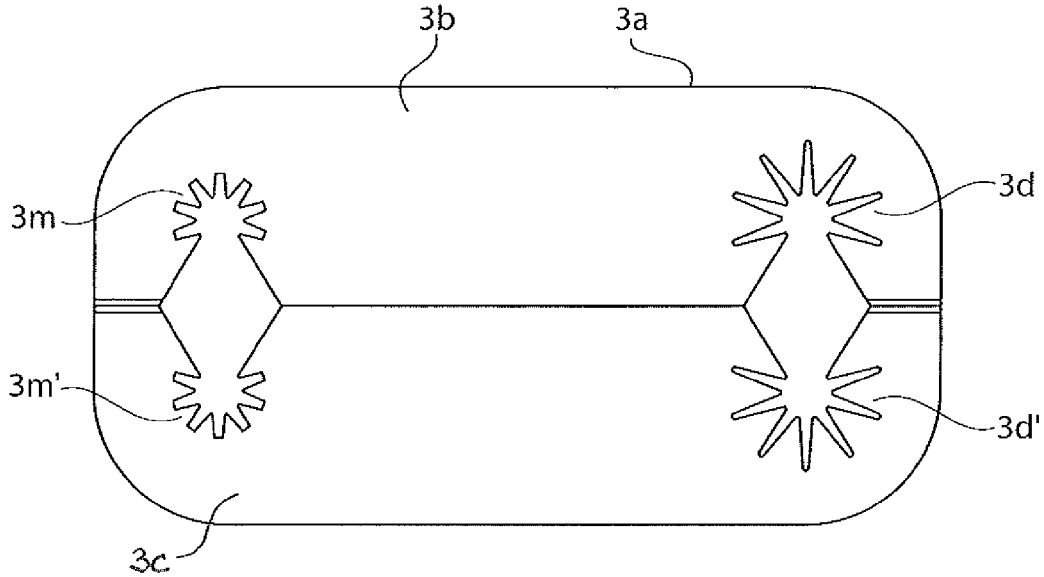
FIGS. 4A and 4B are similar to FIGS. 3A and 3B, but have two cleaning regions on the same body.
Figure 4B:
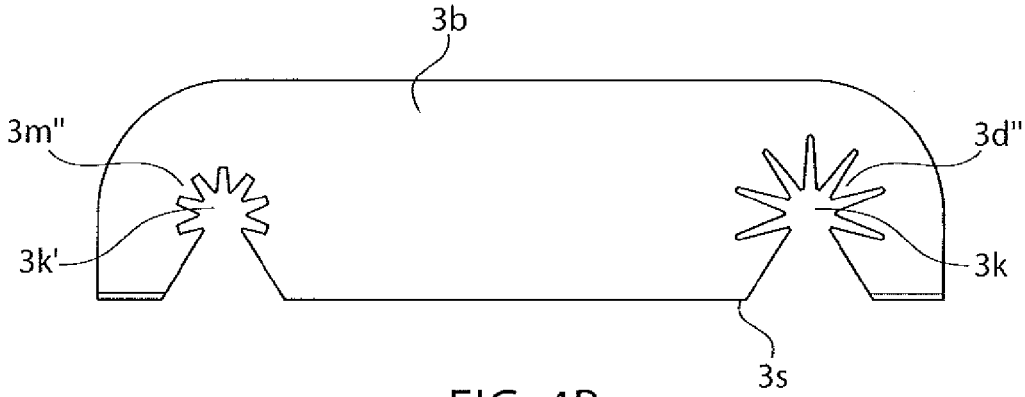

The embodiments of FIGS. 4A and 4B are similar to the embodiments of FIGS. 3A and 3B, but have two sets of complementary cleaning regions (3*d*, 3*d*'; 3*m*, 3*m*') on the same body. As shown the two sets of cleaning regions are different in shape, but in practice they may be the same. In the passageway (3*k*') of the composite cleaning region (3*m*") on the left side of FIG. 4B there are eight inwardly directed triangular projections, separated by seven rectangular spaces. Differently shaped passageways may be provided on the same tool for cleaning differently shaped applicator heads or for cleaning a single applicator head more thoroughly by using one shape of passageway and then using a differently shaped passageway to reach different portions of the applicator head. The number of sets of complementary cleaning regions that may be provided on a single cleaning tool is limited by the size of the tool, but, for example, may be from 1-10 or more.

Figure 5A:
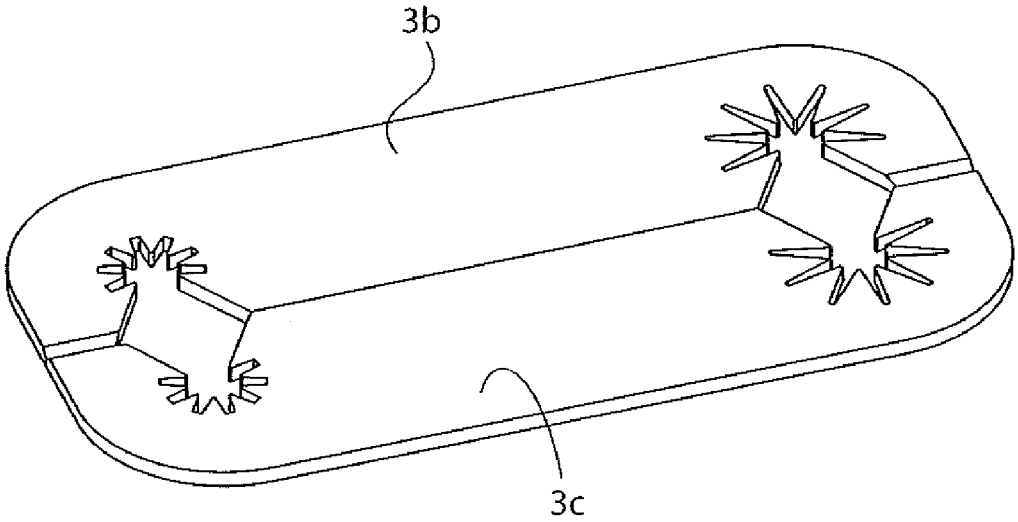
FIGS. 5A and 5B are perspective views of the cleaning tools of FIGS. 4A and 4B, respectively.
Figure 5B:
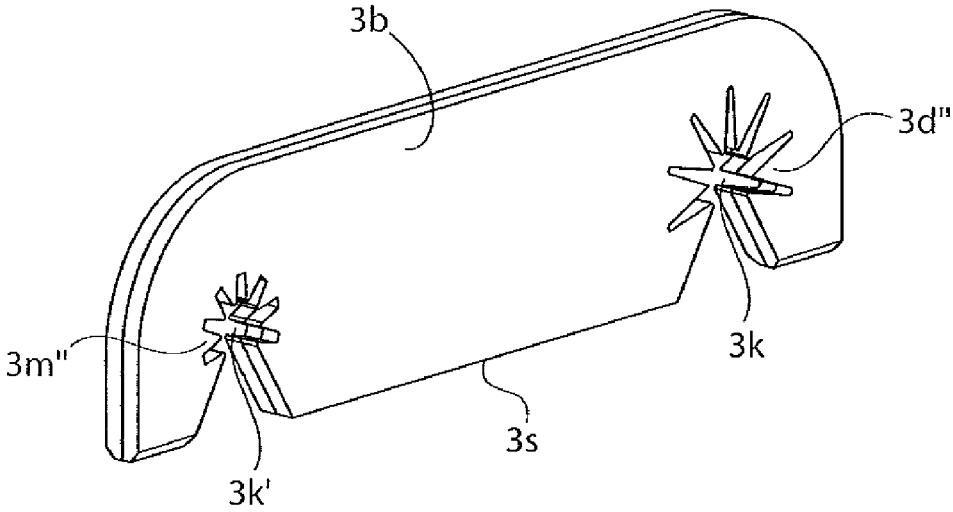

FIGS. 5A and 5B are perspective views of the cleaning tools of FIGS. 4A and 4B, respectively. The thickness of the paper body (3*a*) can be seen in FIG. 5A, which thickness is doubled in FIG. 5B. For folded paper embodiments, the single ply paper thickness may be up to 5 mm thick. For example, from 0.25 mm to 5.0 mm, for example, from 0.5 mm to 3.0 mm, or for example, from 1.0 mm to 2.0 mm. In principle, thicknesses larger than 5 mm could work, but are impractical. The actual thickness used will depend on the rigidity of the paper body and the specific application, and may be determined by trial and error.

Figure 6A:
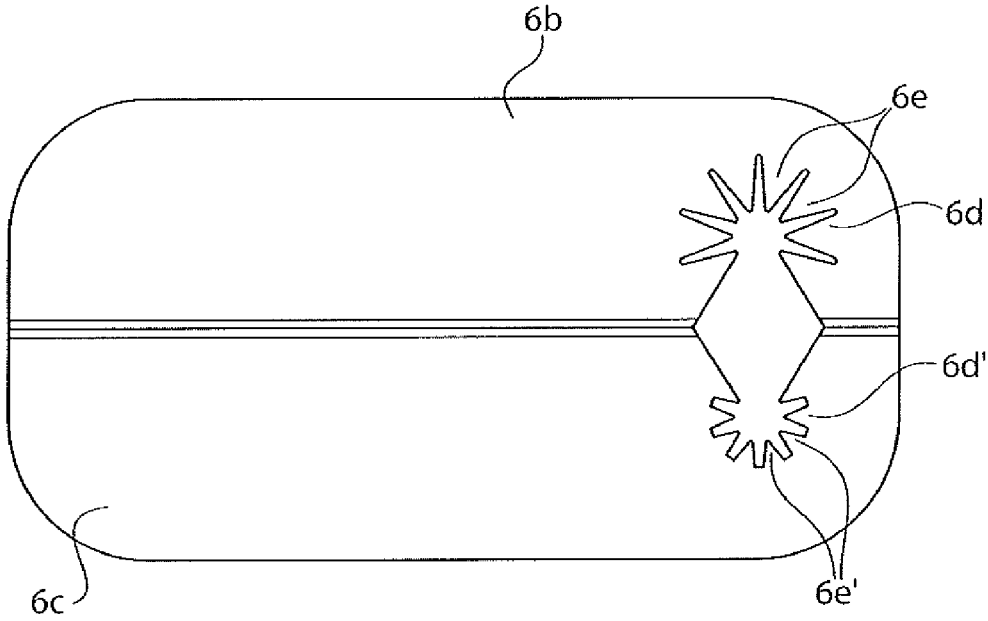
FIGS. 6A and 6B show that the two halves of the cleaning region need not be mirror images of each other.
Figure 6B:
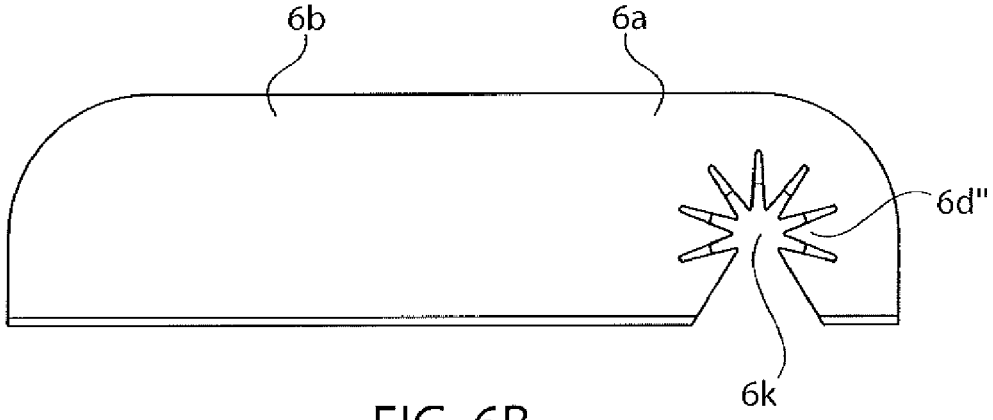

In the folded paper embodiment of FIGS. 6A and 6B, each complementary cleaning region (6*d*, 6*d*') comprises 7 inwardly directed projections (6*e*, 6*e*') that are arranged around the circumference of a circle, spaced about 36° apart. However, the complementary cleaning regions and inwardly directed projections are not the same size and shape. This creates a composite cleaning region (6*d*") that has a passageway (6*k*) that varies along its length from one side of the folded body (6*a*) to the other, and that presents a different surface to the applicator head depending on which direction the applicator head is being drawn through the composite cleaning region (6*d*"). There may be advantages to this which include the ability of the cleaning tool to hold more product, or the ability to more efficiently clean brush applicator heads that have bristles of varying lengths.

Figure 7:
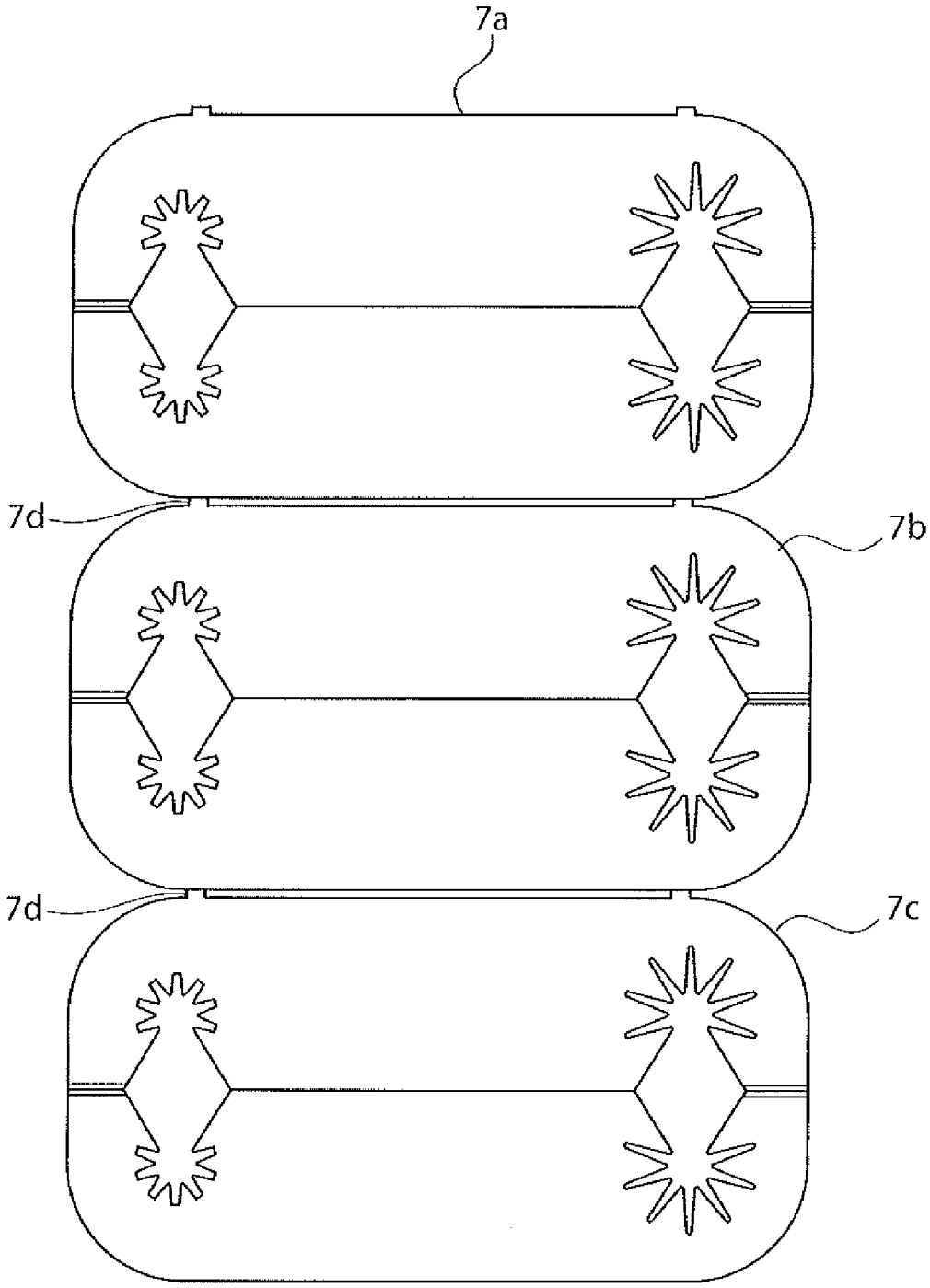
FIG. 7 depicts multiple cleaning tools connected by breakable tabs.

Optionally, more than one paper cleaning tool according to the present invention could be provided in a single sheet. When a new tool is needed it can be separated from the sheet. For example, a scissors could be used to separate one of the cleaning tools. Alternatively, the cleaning tool could be torn from the sheet. In this case, it is preferable if some feature that facilitates tearing could be provided, such as perforations of break-away tabs. For example, FIG. 7 depicts 3 paper cleaning tools (7*a*, 7*b*, 7*c*) connected by tabs (7*d*). When a new tool is needed, it can be removed from the sheet by tearing along the perforations or tabs. Being able to produce multiple cleaning tools one a single sheet may be faster and cheaper than producing individual cleaning tools.

Optionally, the paper used for disposable cleaning tools may be surface coated or surface treated with any useful material or treatment, such as clay coating, polymer coating, and laminating. Such treatments may increase strength, rigidity, impermeability or beneficially affect some other property of the untreated paper to make a more efficient cleaning tool. Likewise, the plastic or other material used for reusable cleaning tools may also be surface treated to impart some benefit.

Cleaning tools according to the present invention are suitable for cleaning personal care applicators, but are particularly useful for cleaning applicators that are used to apply mascara or other product subject to dry out. This is because dried out product will flake off of the applicator head and not stick to the cleaning tool to the degree that moist product would. They may be especially useful for heating applicators which tend to cause product dry out.

Figure 8:
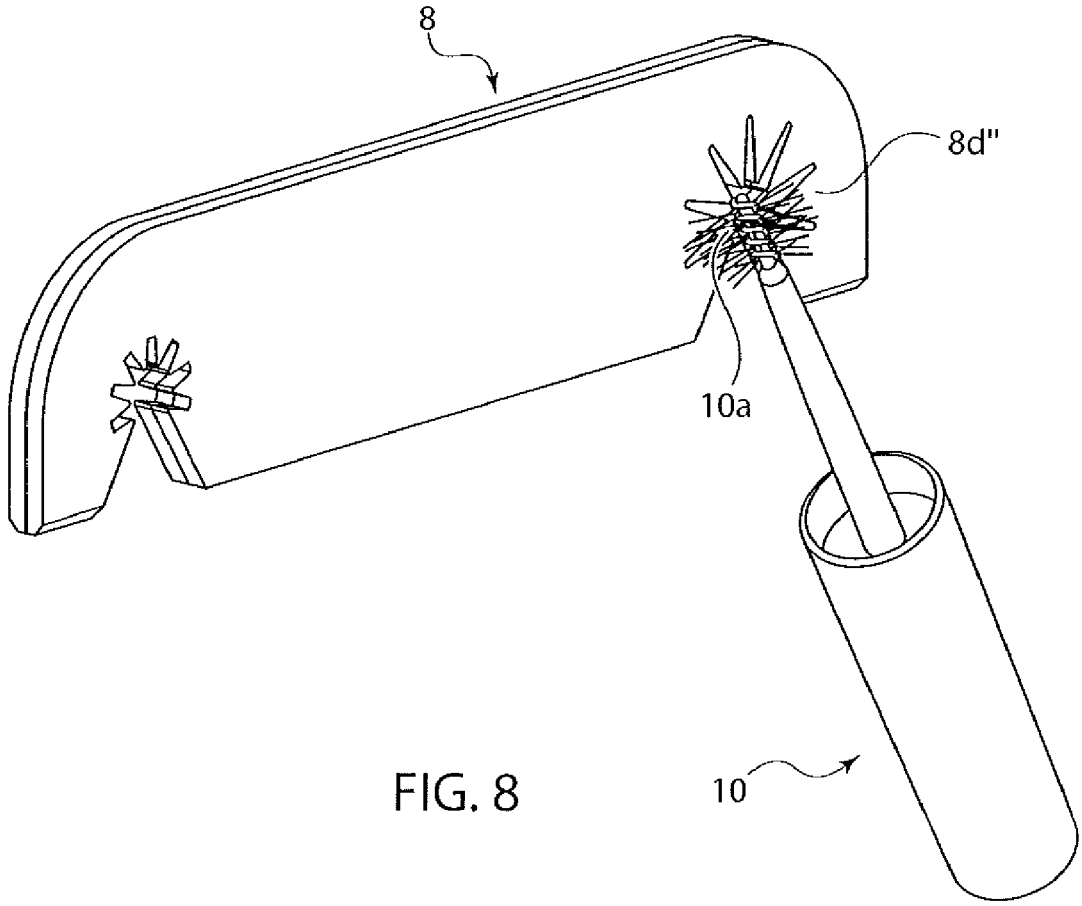
FIG. 8 depicts a mascara brush being cleaned by a disposable cleaning tool.

The cleaning tools according to the present invention are inexpensive to manufacture and effective at removing solid material from the working surface of personal care applicators. Applicators that may be cleaned with a tool according to embodiments of the present invention include brushes (bristles of all types such as nylon or molded elastomer bristles), combs, flocked tip, and sponge tip applicators. FIG. 8 depicts a mascara applicator (10), comprising a bristle brush head (10*a*) partially inserted into composite cleaning region (8*d*") of paper cleaning tool (8).

Methods of Use

Figure 9A:
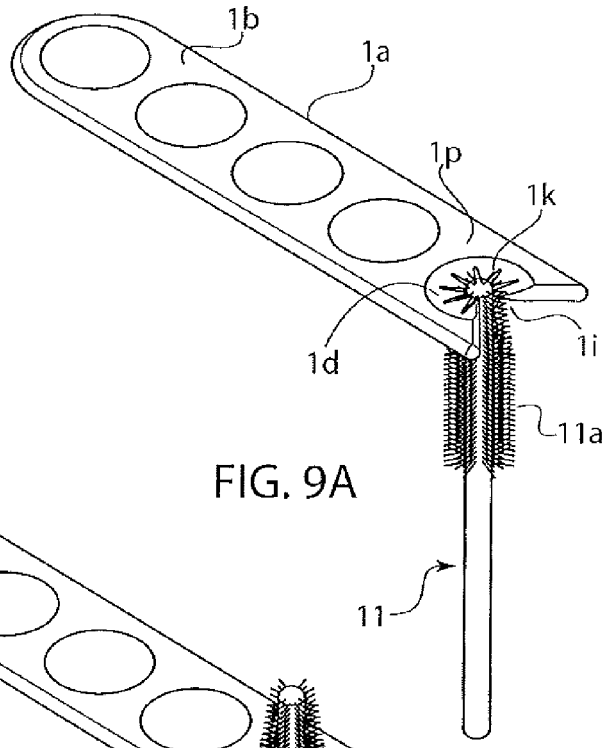
FIGS. 9A,9B,and 9C depict a mascara brush being cleaned by a reusable cleaning tool.
Figure 9B:
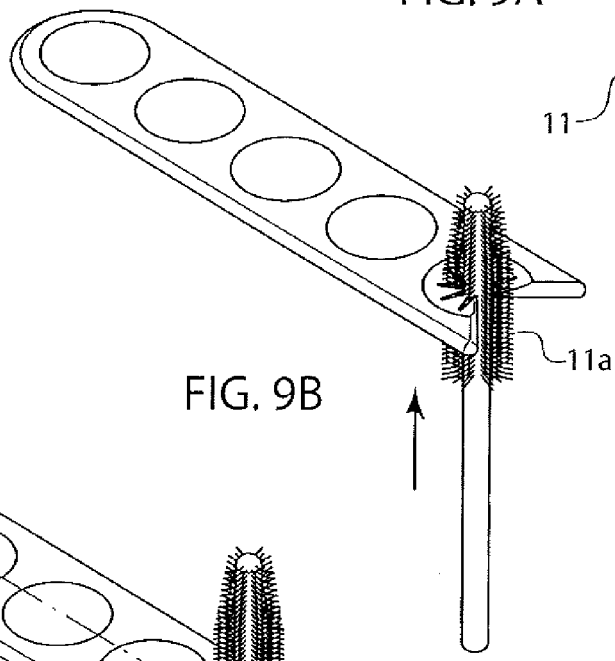
Figure 9C:
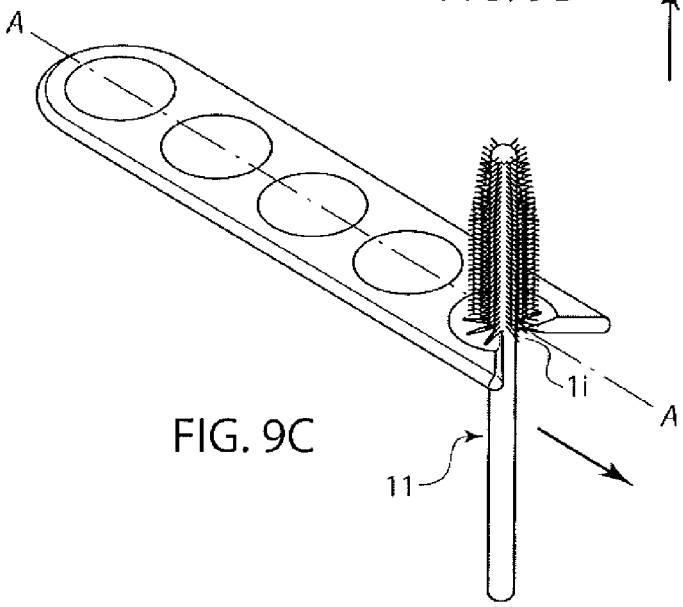

FIGS. 9A-9C depict an applicator (11) being cleaned by a reusable cleaning tool according to the present invention, but the methods apply to disposable cleaning tools as well. As noted above, "parallel to the passageway" means through the passageway along a line connecting the first and second portions (1*p*, 1*q*) of the first and second surfaces (1*b*, 1*c*).

An applicator head is cleaned by moving the applicator head parallel to the passageway, either in a single direction or in a back and forth motion, such that the applicator head is scraped by the projections in the passageway. Furthermore, an applicator may be removed from the cleaning tool, without scraping the applicator head, by moving the applicator perpendicular to the passageway. Thus, methods of using this type of applicator cleaning tool comprise two independent movements of the applicator: a movement parallel to the passage way, and a movement perpendicular to the passageway. These movements may be performed in either order.

For example, in the method depicted in FIG. 9A-C, an applicator head (11*a*) is first introduced into the passageway (1*k*) of the cleaning region (1*d*) by pushing the applicator head through the passageway in a direction that is parallel to the passageway (arrows show the direction of motion of the applicator head). As the applicator head moves through the passageway, the bristles are scraped clean. Once the applicator head is completely through the passageway, the applicator head may be drawn back through the passageway in the opposite direction, but this might cause product to splatter on the user. Instead, the applicator head can be removed from the cleaning tool by moving the applicator (11) perpendicular to the passageway, and through opening (1*i*).

Alternatively, the applicator can be inserted into the passageway (1*k*) by moving the applicator in a direction that is perpendicular to the passageway, and then moving the applicator parallel to the passageway, so that the applicator head passes through the passageway of the cleaning region (1*d*).

Preferably, if the applicator head is moving through the passageway (1*k*) parallel to the passageway, then it is moving away from the user to avoid back splatter. Any of the two step methods may be repeated if necessary, and product that accumulates on the reusable cleaning tool may be cleaned off.

What is claimed is:

1. A method of cleaning a mascara applicator head comprising the steps of:

providing a cleaning tool for cleaning the mascara applicator head comprising:

a body that has one or more exterior surfaces;

at least one cleaning region that is 2 mm-20 mm wide, and that is able to move relative to the mascara applicator head, the cleaning region comprising:

a passageway that has a first end that opens up onto a first portion of the one or more exterior surfaces, and a second end that opens up onto a second portion of the one or more exterior surfaces, wherein the first and the second portions are parallel to each other and separated by an outer edge of the body; and 4-64 inwardly directed projections that extend into the passageway, wherein the passageway opens up along its length onto the outer edge of the body, the opening being defined by an angle that is 15° to 90°;

moving the mascara applicator head parallel to the passageway in one direction, such that the mascara applicator head is scraped by the projections in the passageway; and removing the mascara applicator head from the passageway by moving the mascara applicator head perpendicular to the passageway.

* * * * *